US008046971B2

(12) United States Patent
Lima

(10) Patent No.: US 8,046,971 B2
(45) Date of Patent: Nov. 1, 2011

(54) WALL MADE OF PANELS USED IN PRE-MANUFACTURED CONSTRUCTION

(75) Inventor: Gilmar da Costa Lima, Curitiba (BR)

(73) Assignee: MVC Componentes Plasticos LTDA, San Jose Dos Pinhais/PR (BR)

( * ) Notice: Subject to any disclaimer, the term of this patent is extended or adjusted under 35 U.S.C. 154(b) by 682 days.

(21) Appl. No.: 11/008,518

(22) Filed: Dec. 9, 2004

(65) Prior Publication Data

US 2006/0080913 A1 Apr. 20, 2006

(30) Foreign Application Priority Data

Oct. 18, 2004 (BR) ..... 8402471 U

(51) Int. Cl.
*E04C 2/34* (2006.01)

(52) U.S. Cl. ..... 52/794.1; 52/793.11; 52/796.1; 52/309.7

(58) Field of Classification Search ..... 52/784.14, 52/784.15, 793.1, 793.11, 794.1, 796.1, 796.12, 52/309.4, 309.7, 309.14, 309.15, 309.16; 442/348, 394, 370
See application file for complete search history.

(56) References Cited

U.S. PATENT DOCUMENTS 5,009,043 A * 4/1991 Kurrasch ..... 52/145
5,297,369 A * 3/1994 Dickinson ..... 52/281
5,505,031 A * 4/1996 Heydon ..... 52/281
5,661,273 A * 8/1997 Bergiadis ..... 181/290
5,678,369 A * 10/1997 Ishikawa et al. ..... 52/309.9
5,794,386 A * 8/1998 Klein ..... 52/91.1
5,953,883 A * 9/1999 Ojala ..... 52/794.1
6,158,176 A * 12/2000 Perdue ..... 52/144
6,481,172 B1 * 11/2002 Porter ..... 52/506.01
6,698,157 B1 * 3/2004 Porter ..... 52/794.1
6,713,167 B2 * 3/2004 Di Sante et al. ..... 428/292.1
7,127,856 B2 * 10/2006 Hagen et al. ..... 52/309.9

* cited by examiner

*Primary Examiner* — Jessica Laux
(74) *Attorney, Agent, or Firm* — Alston & Bird LLP

(57) ABSTRACT

This invention provides a new wall arrangement in panels composed of glass wool and fire resistant thermal and acoustical insulating material, adequate for any kind of land and weather condition, to create a habitable environment that may be utilized in many applications such as houses, attendance stations, schools, first aid stations, motels and others. The objective of this invention is to present the conception of a modular wall which comprises a structure composed of a sheet of glass wool, with a wooden frame core and the upper part designed to support cabinets, exhaust fans, and other utensils, offering good mechanical resistance, and receiving in the interior of the hollow areas of the wooden frame, a layer of expanded polystyrene, with grooves to receive the ribs of rock wool. To complete its composition, the structure also has rock wool internal panels, wooden frame with the upper area, a new layer of expanded polystyrene, and completing the assembly a plate of glass wool is added.

10 Claims, 5 Drawing Sheets

WALL MADE OF PANELS USED IN PRE-MANUFACTURED CONSTRUCTION

FIELD OF THE INVENTION

This invention relates to a new wall arrangement in panels composed of glass wool and fire resistant thermal and acoustical insulating material, adequate for any kind of land and weather condition, to create a habitable environment that may be utilized in many applications such as houses, attendance stations, schools, first aid stations, motels and others.

BACKGROUND OF THE INVENTION

Nowadays, all kinds of materials are used to fabricate modular wall panels for houses, such as dry wall, concrete, laminated plastic, among others. However, these modules present some inconveniences when exposed to changes in weather conditions. In addition to that, the handling of the existing modular walls is very difficult due to their elevated weight and the material used to install them generates too much waste, producing a dirty job site and a harmful environment to the workers' health.

The objective of this invention is to present the conception of a modular wall which produces a habitable environment with a finishing of good quality, low cost, quick installation, and with no harmful waste to the environment and the workers. This is achieved through a new conception of modular construction which comprises a pre-fabricated construction based on structural walls that may be used as external and internal walls, fabricated in panels composed of glass wool and a filling consisting of an insulating and thermo-stable material, producing a double decker sandwich with two layers of expanded polystyrene, one internal layer of rock wool and a lining of plastic plates reinforced with glass wool, being finally structured by a wooden woof and rock wool ribs, forming a fire resistant structure, which assures thermal and acoustical comfort and excellent durability. The walls do not require painting, but they take any type of usual finishing.

BRIEF DESCRIPTION OF THE DRAWINGS

In order to help understand the new arrangement of pre-fabricated wall panels, objective of this utility model, as well as the advantages of the process, the following explanations were added, accompanied by figures.

DETAILED DESCRIPTION OF THE INVENTION

Figure 1:
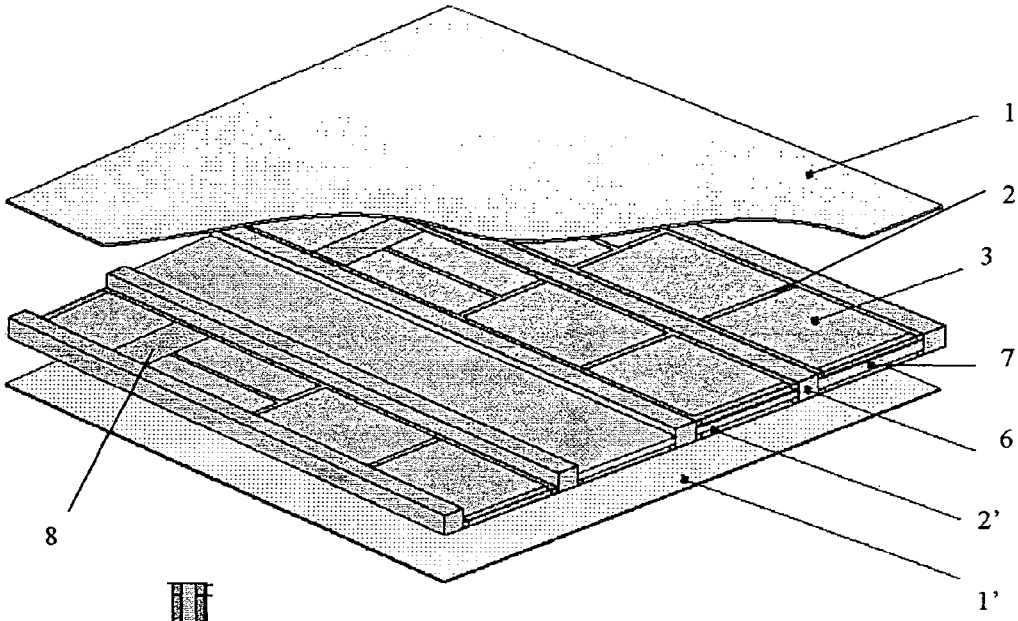
FIG. 1 is an exploded perspective of the proposed panel.
Figure 2:
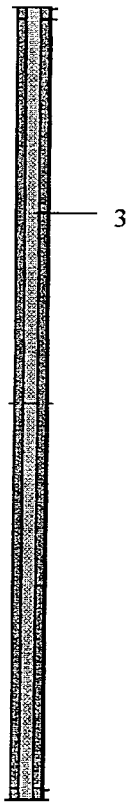
FIG. 2 is a cross section of the proposed panel.
Figure 3:
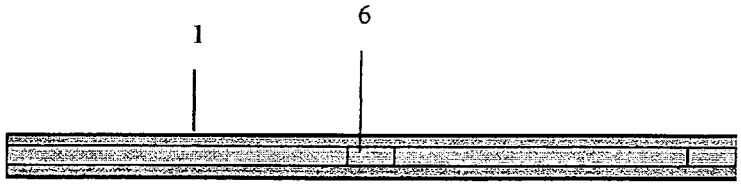
FIG. 3 is an upper view of the panel.
Figure 4:
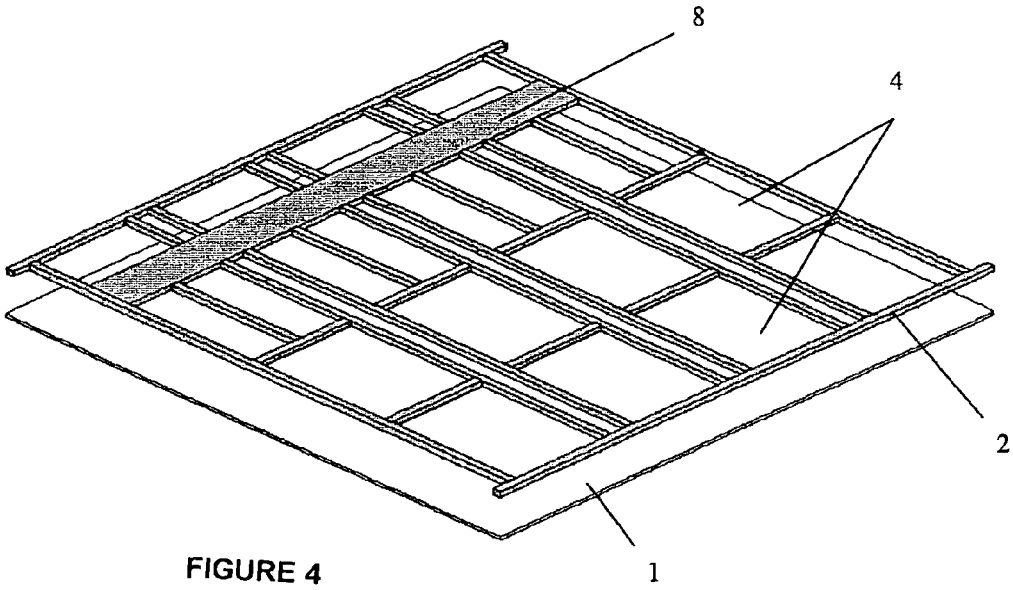
FIGS. 4 THROUGH 10 are perspective views of the panel including sequence of fabrication and composition.
Figure 5:
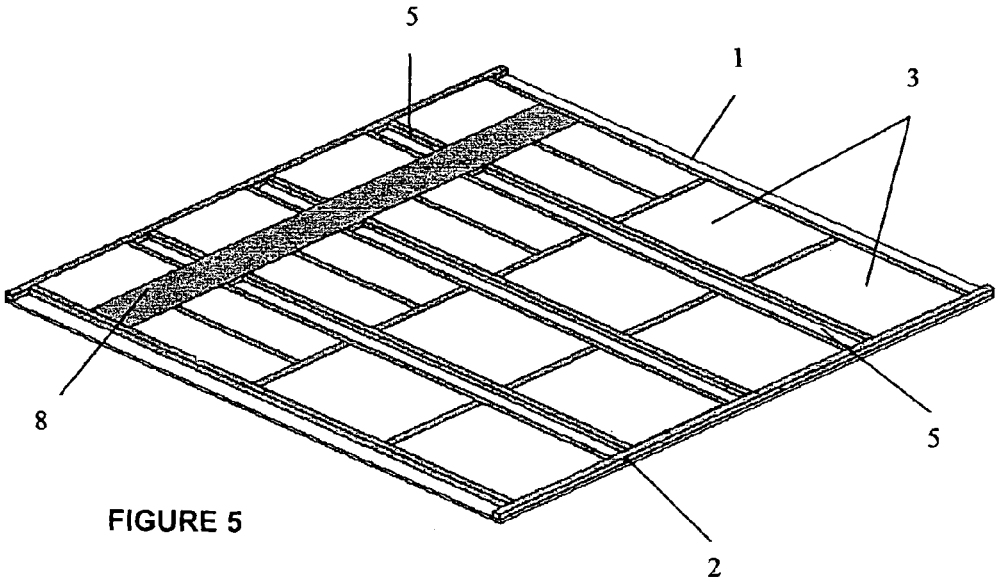
Figure 6:
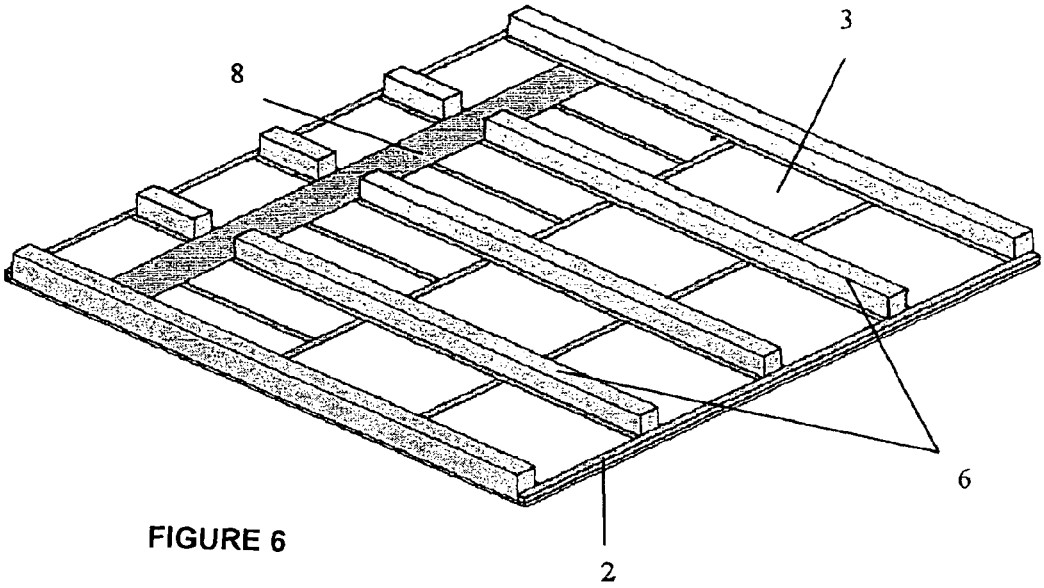
Figure 7:
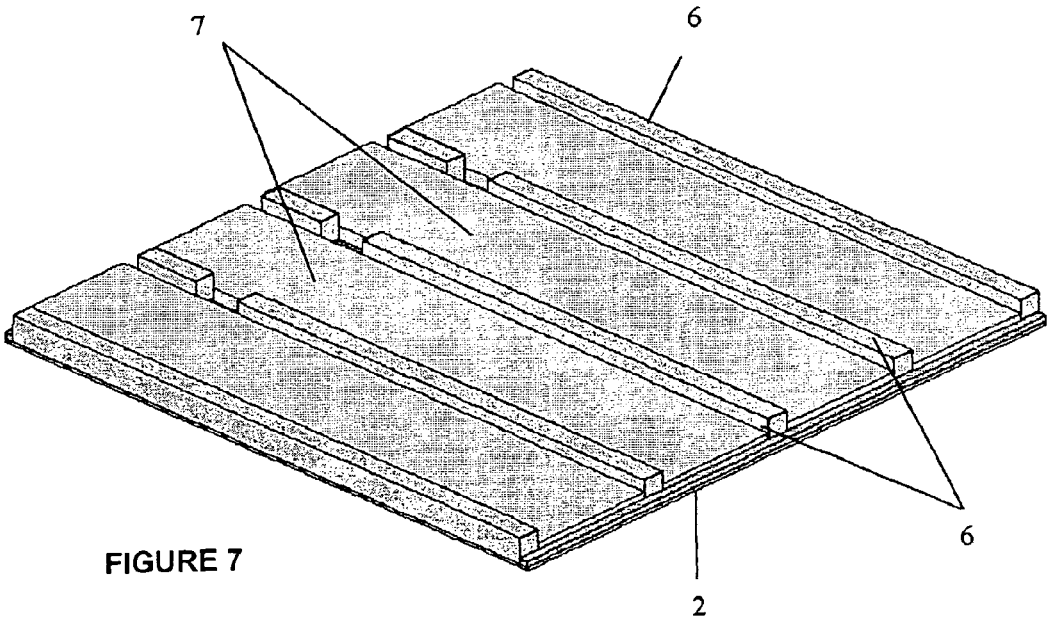
Figure 8:
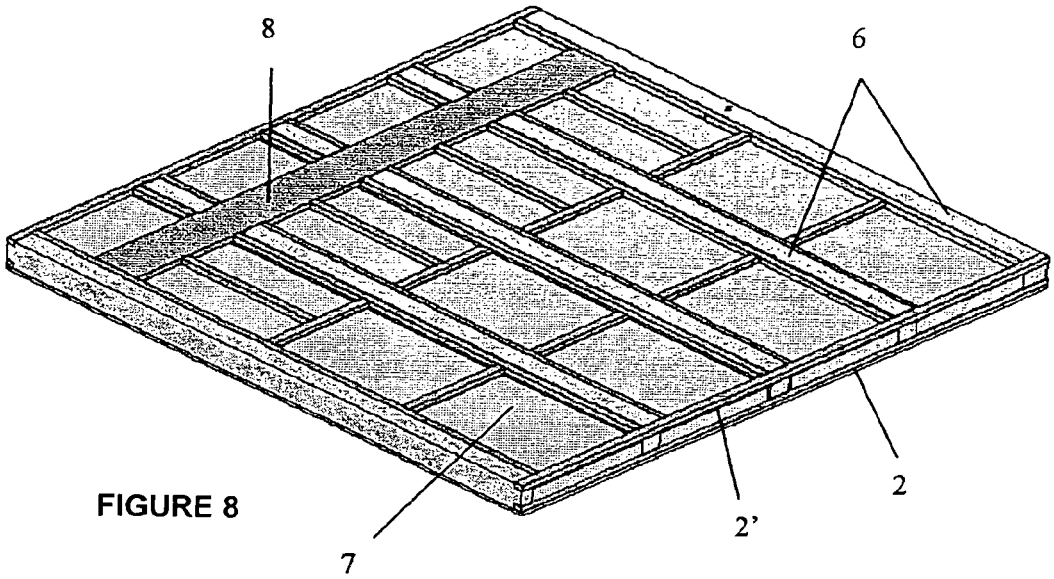
Figure 9:
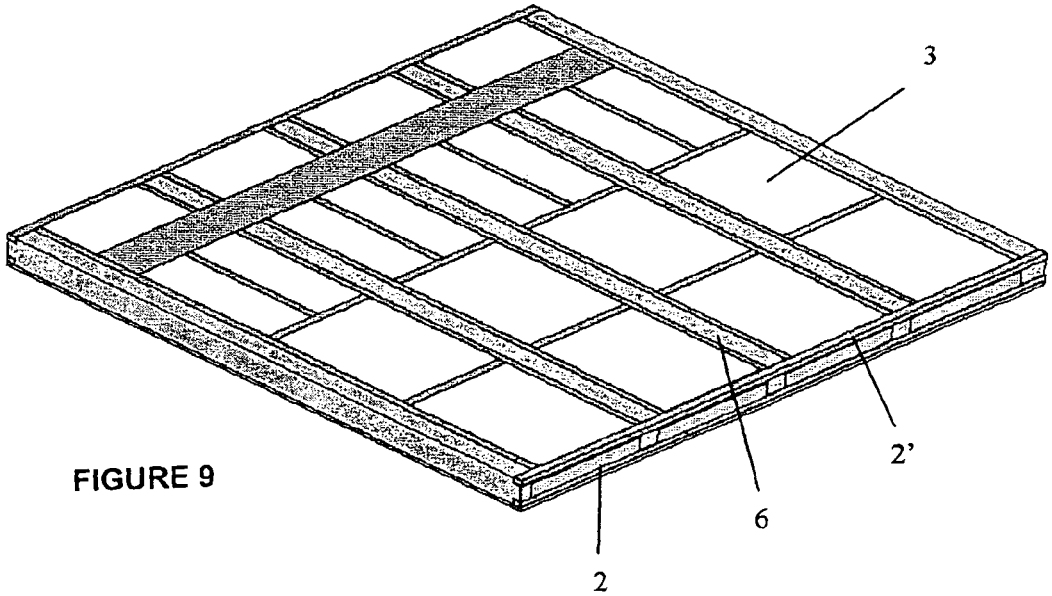
Figure 10:
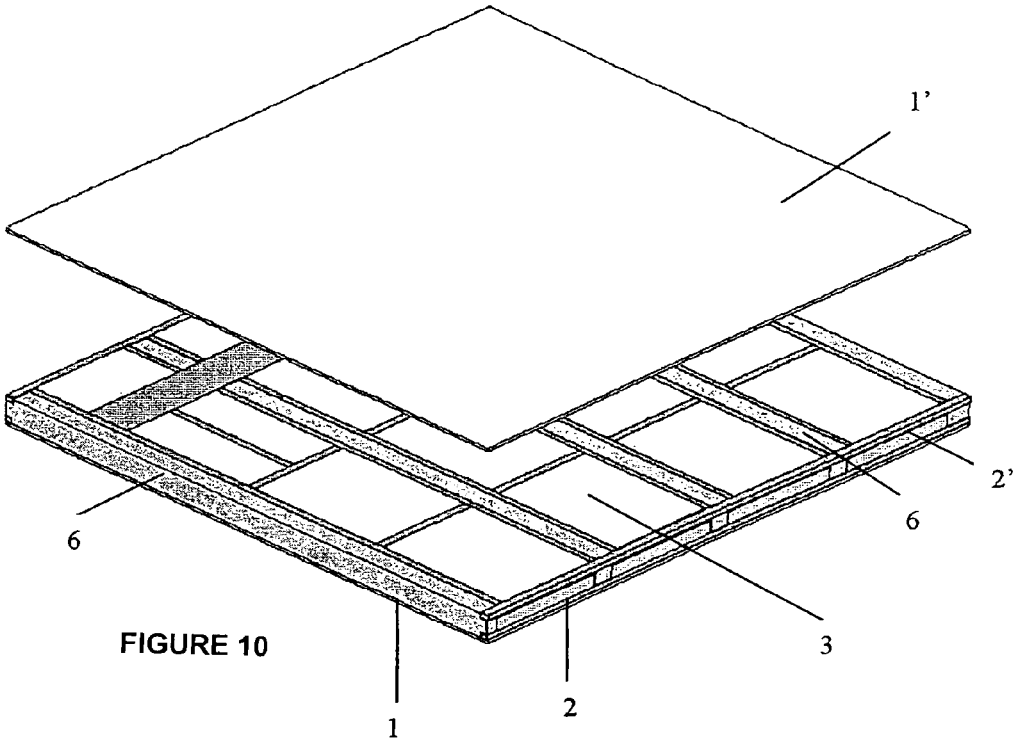
Figure 11:
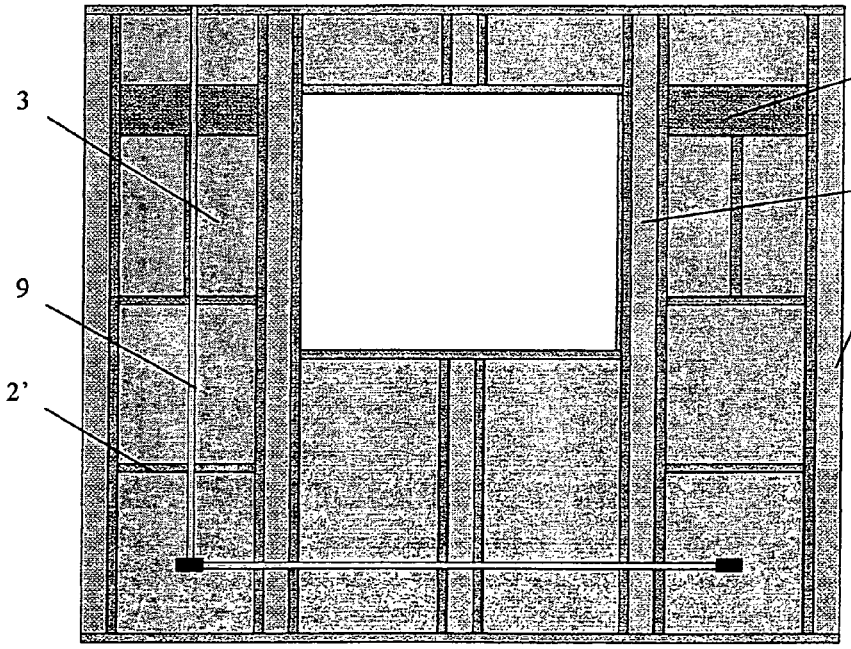
FIG. 11 is a front view of the panel including groove.

According to FIGS. 1 through 11 the arrangement of the wall in panels comprises a structure composed of a sheet (1) of glass wool with a wooden frame core (2) and the upper part (8) designed to support cabinets, exhaust fans and other utensils, offering good mechanical resistance, and receiving in the interior of the hollow areas (4) of the wooden frame core (2), a layer of expanded polystyrene (3), with grooves (5) to receive the ribs of rock wool (6). To complete its composition, the structure also has rock wool internal panels (7), wooden frame (2') with the upper area (8), a new layer of expanded polystyrene (3), and to complete the assembly a plate (1') of glass wool is added.

Panels with grooves (9) for electrical installations are also available in different shapes to accommodate switches, outlets, embedded in the proper place.

For walls with doors, windows or other elements that require special openings, the same arrangement of the modules of the wood woof and the rock wool ribs is adopted, thus allowing openings according to the requirements.

The wood framing work in the rock wool and expanded polystyrene occurs before the assembly of the panel, by means of clamps, which attach the rock wool to the two frames.

The plates (1) and (1') of glass wool are made through an extrusion process, in which the raw material, consisting of gel coat or pigment, low viscosity polyester resin with tri-hydrated alumna (aluminum oxide) and glass wool is dispensed over a polyester film which slides on a flat surface. The components of the raw material are dispensed in different phases over the polyester film, and after that, another polyester film is placed on top of the first layer and the raw material; in the next phase the "sandwich" is compacted by means of cylinders that determine the thickness of the plate. After the material is compacted, the plates travel a certain distance over a heated table to complete the cure, transforming the "sandwich" in a rigid plate.

In order to transform the plates (1) and (1') into panels, a core is added and the materials, including plate (1)+core prepared according to the above description+glass wool plate (1'), are glued through a vacuum or pressing process. The process starts with the sandpapering of the internal faces of the two plates (1) and (1') which will be glued together. The glass wool plate (1) with the adhesive, then the core composed of the wood (2) and (2'), rock wool ribs (6), internal panel in rock wool (7) and expanded polystyrene (3), are placed in the press; then the set is completed with the second glass wool plate (1'), and finally the panel is submitted to vacuum for the pressing and gluing operations.

The composition in plates (1 and 1') and core (2, 2', 3, 6, and 7) produces a panel with fire and mechanical resistance, thermal and acoustical comfort, and waterproof, all in accordance with standard requirements.

What is claimed is:

1. A wall panel for pre-fabricated construction comprising a core, wherein the core comprises:

(i) a first wooden frame having a central body portion with top, bottom and opposing side edges, said central body portion defining a plurality of hollow cavities therein, each of the plurality of hollow cavities being filled with a layer of expanded polystyrene;

(ii) a second wooden frame opposing the first wooden frame having a central body portion with top, bottom and opposing side edges, said central body portion defining a plurality of hollow cavities therein, each of the plurality of hollow cavities being filled with a layer of expanded polystyrene, wherein the first and second wooden frames are positioned in a parallel spaced apart relation to each other whereby the first and second wooden frames do not overlap through an imaginary plane running between and parallel to both of the wooden frames, and wherein the first and second wooden frames define a plurality of grooves therein, said grooves extending through the central body portions of the first and second wooden frames;

(iii) a plurality of ribs comprising rock wool positioned within the grooves defined by the first and second wooden frames; and (iv) at least one internal layer comprising rock wool sandwiched between the first wooden frame and the second wooden frame.

2. The wall panel of claim 1, wherein at least one of the first wooden frame and the second wooden frame further comprises a support area adapted for supporting objects external to the wall panel.

3. The wall panel of claim 1, wherein the core is sandwiched between a first glass wool plate and a second glass wool plate.

4. The panel of claim 1, wherein the panel further comprises at least one electrical groove adapted to accommodate installation of electrical components.

5. The wall panel of claim 1, wherein only one rib is positioned within each groove defined by the first and second wooden frames.

6. A method of preparing a wall panel for pre-fabricated construction comprising:

(i) providing a core comprising:

(a) a first wooden frame having a central body portion with top, bottom and opposing side edges, said central body portion defining a plurality of hollow cavities therein, each of the plurality of hollow cavities being filled with a layer of expanded polystyrene;

(b) a second wooden frame opposing the first wooden frame and having a central body portion with top, bottom and opposing side edges, said central body portion defining a plurality of hollow cavities therein, each of the plurality of hollow cavities being filled with a layer of expanded polystyrene, wherein the first and second wooden frames are positioned in a parallel spaced apart relation to each other whereby the first and second wooden frames do not overlap through an imaginary plane running between and parallel to both of the wooden frames, and wherein the first and second wooden frames define a plurality of grooves therein, said grooves extending through the central body portions of the first and second wooden frames;

(c) a plurality of ribs comprising rock wool positioned within the grooves defined by the first and second wooden frames; and (d) at least one internal layer comprising rock wool sandwiched between the first wooden frame and the second wooden frame; and (ii) clamping the core; and (ix) adhering a first glass wool plate and a second glass wool plate to opposite sides of the core.

7. The method of claim 6, further comprising producing a first glass wool plate and a second glass wool plate, wherein the process for producing each glass wool plate comprises:

(i) dispensing a gel coat or pigment, a low viscosity polyester resin with tri-hydrated alumna (aluminum oxide), and glass wool in different phases over a first polyester film;

(ii) placing a second polyester film over the first polyester film such that the gel coat or pigment, the low viscosity polyester resin with tri-hydrated alumna (aluminum oxide), and the glass wool are sandwiched between the first polyester film and the second polyester film and defining a sandwich;

(iii) compacting the sandwich;

(iv) curing the sandwich, thereby transforming the sandwich into a rigid plate.

8. The method of claim 6, wherein the adhering step comprises gluing the first glass wool plate and the second wool plate to opposite sides of the core through a vacuum or pressing process.

9. A wall panel for pre-fabricated construction, comprising:

(a) a first glass wool plate and a second glass wool plate;

(b) a core, wherein the core comprises;

(i) a first wooden frame having a central body portion with top, bottom and opposing side edges, said central body portion defining a plurality of hollow cavities therein, each of the plurality of hollow cavities being filled with a layer of expanded polystyrene;

(ii) a second wooden frame opposing the first wooden frame having a central body portion with top, bottom and opposing side edges, said central body portion defining a plurality of hollow cavities therein, each of the plurality of hollow cavities being filled with a layer of expanded polystyrene, wherein the first and second wooden frames are positioned in a parallel spaced apart relation to each other whereby the first and second wooden frames do not overlap through an imaginary plane running between and parallel to both of the wooden frames, and wherein the first and second wooden frames define a plurality of grooves therein, said grooves extending through the central body portions of the first and second wooden frames;

(iii) a plurality of ribs comprising rock wool positioned within the grooves defined by the first and second wooden frames; and (iv) at least one internal layer comprising rock wool sandwiched between the first wooden frame and the second wooden frame; wherein the core is sandwiched between the first glass wool plate and the second wool plate, wherein each glass wool plate has a central body portion with top, bottom and opposing side edges, and wherein the central body portions of the wooden panels are parallel to the central body portions of the wool plates; and (c) an opening extending through the wall panel; wherein the opening extends through the first glass wool plate, the core, and the second glass wool plate.

10. The wall panel of claim 9, wherein only one rib is positioned within each groove defined by the first and second wooden frames.

* * * * *